US007527425B2

(12) United States Patent
Born

(10) Patent No.: US 7,527,425 B2
(45) Date of Patent: May 5, 2009

(54) DEVICE AND METHOD FOR SECURING A PALLET-STONE TO AN ESCAPEMENT PALLET OF A TIMEPIECE MOVEMENT

(75) Inventor: Jean-Jacques Born, Morges (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/599,275

(22) PCT Filed: Mar. 8, 2005

(86) PCT No.: PCT/EP2005/002411

§ 371 (c)(1),
(2), (4) Date: Nov. 30, 2007

(87) PCT Pub. No.: WO2005/103843

PCT Pub. Date: Nov. 3, 2005

(65) Prior Publication Data

US 2008/0101162 A1 May 1, 2008

(30) Foreign Application Priority Data

Mar. 23, 2004 (EP) ..... 04006893

(51) Int. Cl.
*G04B 15/14* (2006.01)

(52) U.S. Cl. ..... 368/131; 368/129

(58) Field of Classification Search ..... 368/131, 368/129–130

See application file for complete search history.

(56) References Cited

U.S. PATENT DOCUMENTS

| | | | | |
|---|---|---|---|---|
| 581,535 | A | 4/1897 | Church | |
| 3,738,101 | A * | 6/1973 | Simon-Vermot | 368/125 |
| 4,293,942 | A * | 10/1981 | Baumgartner | 368/280 |

FOREIGN PATENT DOCUMENTS

| | | |
|---|---|---|
| CH | 18058-67 | 11/1969 |
| EP | 0 918 264 A1 | 5/1999 |
| JP | 05-220849 | 8/1993 |

OTHER PUBLICATIONS

International Search Report issued in corresponding application No. PCT/EP2005/002411, completed Jun. 24, 2005 and mailed Jun. 30, 2005.

Berner, G.-A., "Illustrated Professional Dictionary of Horology I+II," 2002 combined printing of 1961 and 1995 vol. pp. 41 and 809.

Jackson, C.M. et al., "55- Nitinol-The Alloy with a Memory: It's Physical Metallurgy, Properties, and applications—A Report," National Aeronautics and Space Administration (NASA), NASA SP-5110, 1972.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The invention concerns a device for securing a pallet stone to an escapement pallet including at least one housing for receiving said pallet stone, characterized in that the portion of the pallet including said housing is made of a shape memory alloy able to undergo a reversible transformation from an austenitic crystallographic phase to a martensitic crystallographic phase.

5 Claims, 2 Drawing Sheets

DEVICE AND METHOD FOR SECURING A PALLET-STONE TO AN ESCAPEMENT PALLET OF A TIMEPIECE MOVEMENT

This is a National Phase Application in the United States of International Patent Application No. PCT/EP2005/002411 filed Mar. 8, 2005, which claims priority on European Patent Application No. 04006893.4, filed Mar. 23, 2004. The entire disclosures of the above patent applications are hereby incorporated by reference.

FIELD OF THE INVENTION

The present invention concerns a device for securing a pallet-stone to an escapement pallet of a watch movement, and more particularly a device of this type that does not use shellac bond. The present invention also concerns a method for securing a pallet-stone to an escapement pallet of a watch movement.

BACKGROUND OF THE INVENTION

In the watchmaking business, the escapement is the mechanism placed between the gear train of a watch movement and its regulator, for example the balance of the watch movement, the function of the escapement being to maintain the oscillations of the balance and control the speed of the gear train.

With reference to FIG. 1, an escapement 1 of a watch with a conventional pallet will briefly be described. Escapement 1 comprises an escapement wheel 2, a pallet 4 and a large roller 6 carrying an impulse pin 8 and a small roller 10 provided with a notch 11 carried by the balance staff 12. The pallet comprises two pallet-stones 14 cooperating with wheel 2 and a lever 16 ending in a fork 17 with three teeth cooperating with the large and small rollers 6 and 10 respectively. These pallet-stones 14 are each secured in a suitable housing or recess 18 provided in arms 19 of pallet 4. Fork 17 comprises two outer teeth 20 which cooperate with impulse pin 8 whereas the inner tooth or dart 22 cooperates with small roller 10 and prevents pallet 4 inadvertently overbanking during the additional oscillation of the balance (not shown). The movements of pallet 4 are limited by pins or stop members 24 against which lever 16 abuts. In the rest position, lever 16 abuts against one of the two stop pins 24. At this moment, one tooth 2*d* of escapement wheel 2 is pressed against one of pallet-stones 14 as is shown in FIG. 1. The inner tooth 22 of fork 17 is released from notch 11 such that the balance is released and covers a distance in the anti-clockwise direction S, the amplitude of which is determined by the accumulated energy. The balance then sets off in the clockwise direction to release pallet-stone 14 from tooth 2*d*. After the impulse imparted to pallet-stone 14 by tooth 2*d*, the pallet covers a small idle distance, called the backlash, until the moment when lever 16 abuts against pin 24. The balance then covers its amplitude, and returns until impulse-pin 8 of large roller 6 drives fork 17, which releases the following impulse. This backlash is a way of ensuring that all the teeth of escapement wheel 2 can pass. The length of the backlash is a function of the penetration p of the tooth of escapement wheel 20 onto the rest plane 27 of pallet-stone 14, said penetration having to be both sufficient to prevent the inadvertent release of escapement wheel 2, for example when there is a shock, and sufficiently slight to ensure that the teeth of escapement wheel 2 are released in all operating circumstances in order to obtain an escapement 1 with optimum yield. The means for securing the pallet-stone are critical for the escapement to operate properly and have to allow the possibility of adjusting penetration P.

In order to attain this object, the pallet-stones are currently secured in their housings by means of shellac bond. Shellac bond is a natural organic adhesive which has the advantage of being able to melt at any time at a low temperature and into a thick sticky liquid and thus enabling the position of the pallet-stones to be adjusted easily and precisely.

The use of shellac bond has, however, some drawbacks. In fact, shellac bond is very sensitive to the chemical agents used for washing movements and consequently releases shellac bond particles which stick to various places on the movement. Depending upon the place, these particles can considerably affect the escapement efficiency and consequently disturb the working of the watch.

Moreover, since it is a natural product, its properties are not constant so that the quality of the shellac bond can vary from one delivery to another.

Furthermore, implementation of shellac bond takes a long time and is difficult, requiring great dexterity to apply the optimum quantity of shellac bond in the pallet housing in order to properly secure the pallet-stones on the pallet.

It is thus a main object of the invention to overcome the aforementioned drawbacks of the prior art by providing a device for securing a pallet-stone on a pallet which secures the pallet-stone reliably without using shellac bond or any other adhesive while allowing the penetration of the pallet-stone into the toothing of the escapement wheel to be easily and precisely adjusted.

It is also an object of the invention to provide a device of this type that is easy to implement and secures the pallet-stone precisely and economically.

SUMMARY OF THE INVENTION

The invention therefore concerns a device for securing a pallet-stone to an escapement pallet comprising at least one housing provided for receiving said pallet-stone, characterized in that the portion of the pallet comprising said housing or any pallet is made of a shape memory alloy capable of undergoing a reversible transformation from an austenitic crystallographic phase to a martensitic crystallographic phase.

It is known that shape memory alloys have the property of being able to undergo a reversible transformation from a high temperature crystallographic phase called an austenitic phase, to a low temperature martensitic phase and thus being able to be educated, in certain temperature conditions, to take configurations corresponding to memorised states. In particular, if an object made of such an alloy is educated to memorise a determined configuration in its austenitic phase, and the object is subsequently deformed while it is in its martensitic phase, it remains in its deformed configuration. If the object is then heated to bring it to a temperature at which it is in its austenitic phase, it tends to return to its non-deformed configuration, i.e. the configuration of its memorised state.

Thus, by using these properties, it is possible to secure a pallet-stone to a pallet made of a shape memory alloy in a simple manner, avoiding the use of shellac bond and the drawbacks linked thereto. The use of a shape memory alloy to secure a pallet-stone also allows a pallet and pallet stones to be made with wide tolerances without thereby affecting the efficiency of compression insofar as the deformations permitted by such an alloy easily compensates for such tolerances. Another advantage of using a shape memory alloy to secure a pallet-stone to a pallet lies in the possibility of assembling (gripping) and dismantling (releasing) the pallet-stone in its housing a large number of times without damaging it simply by heating or respectively cooling the pallet. This is a great advantage for adjusting penetration P.

In fact, according to a first embodiment of the invention, one could, for example, educate the portion of the pallet comprising the housing receiving the pallet stone so that the housing does not grip the pallet stone in a substantial manner and allows the pallet stone to be moved in the latter when the pallet is brought to a determined temperature at which its crystallographic phase is in the austenitic phase and it fixedly secures the pallet stone when said portion of the pallet is in the martensitic crystallographic phase at the ambient temperature. In such case, one has only to heat the portion of the pallet comprising the housing to the determined temperature, which will depend upon the composition of the alloy, in order to introduce and adjust the pallet stone in the housing, then return the pallet to its martensitic crystallographic phase at the ambient or operating temperature.

According to a second embodiment of the invention, the portion of the pallet comprising the housing receiving the pallet stone can also be educated such that the housing does not grip the pallet stone in a substantial manner and allows the pallet stone to move in the latter when the pallet is in its martensitic crystallographic phase and such that it securely grips the pallet stone when said portion of the pallet is in the austenitic crystallographic phase while it is at the ambient temperature. In such case, one only has to cool the portion of the pallet comprising the housing to a determined temperature lower than the ambient temperature, which will depend upon the composition of the alloy, in order to introduce and adjust the pallet stone in the housing, then return the pallet to the temperature lower than the ambient temperature in order to return the pallet to its austenitic crystallographic phase.

BRIEF DESCRIPTION OF THE DRAWINGS

Other features and advantages of the invention will appear more clearly upon reading the following description of an embodiment of the invention, given purely by way of non-limiting illustration, this description being given with reference to the annexed drawings, in which.

DETAILED DESCRIPTION OF THE INVENTION

Figure 1:
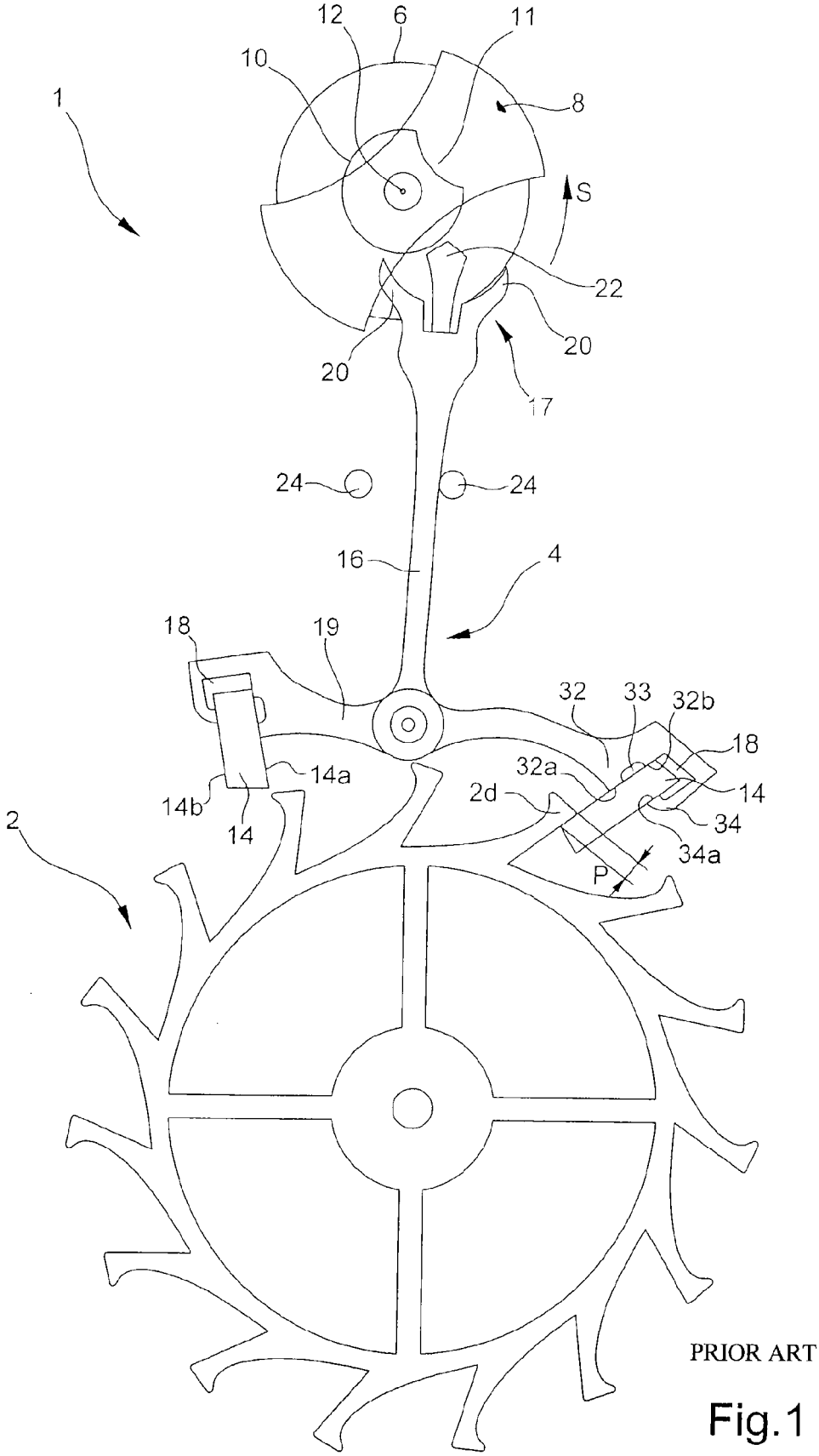
PRIOR ART Fig.1
FIG. 1, already described, is a top view of a conventional escapement system.
Figure 2A:
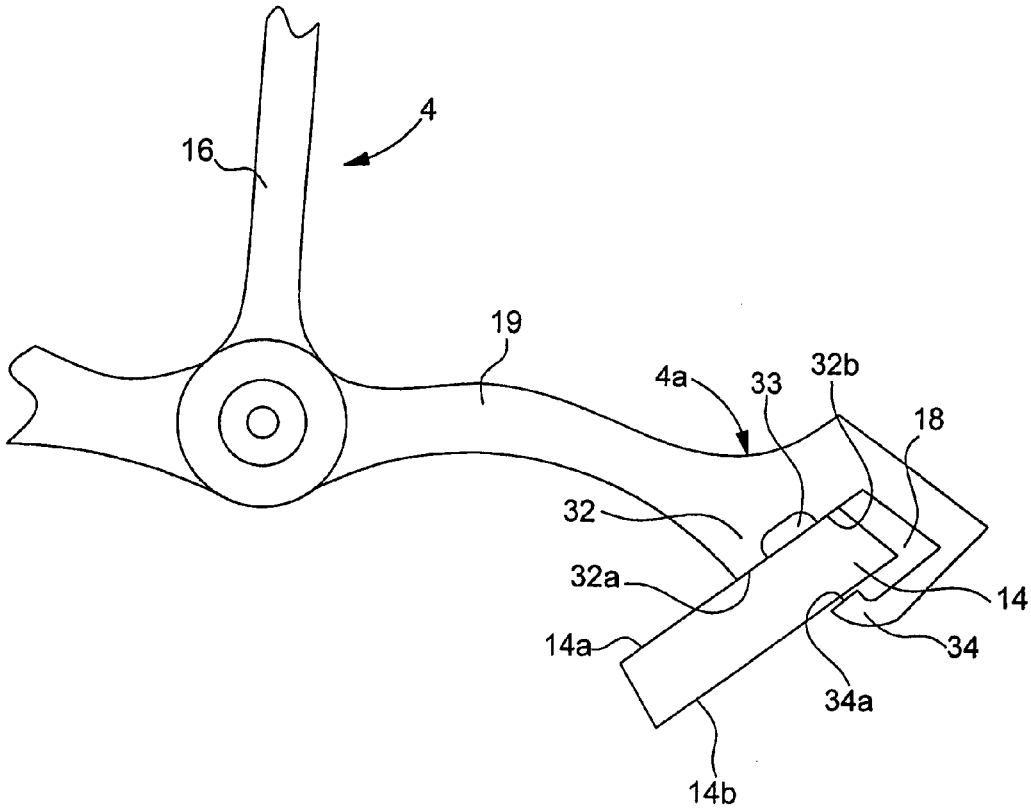
FIG. 2*a* shows a detail of FIG. 1 illustrating the portion of the pallet comprising the housing receiving the pallet stone in an adjustment configuration.
Figure 2B:
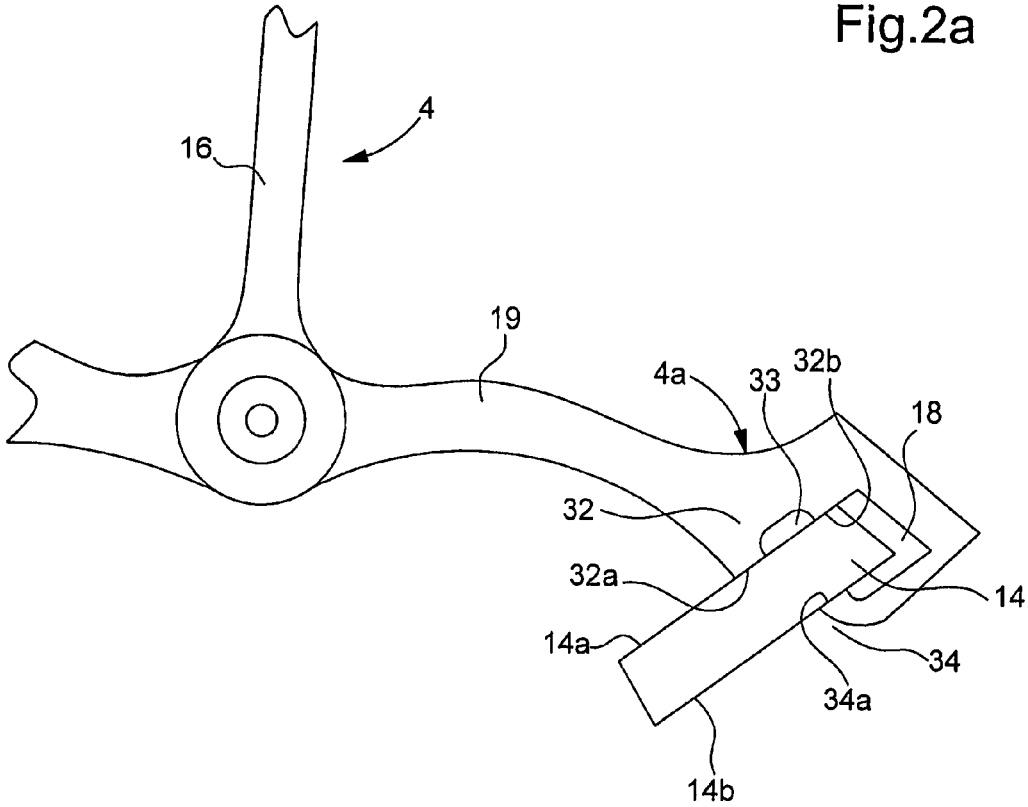
FIG. 2*b* shows a detail of FIG. 1 illustrating the portion of the pallet comprising the housing receiving the pallet stone in a gripping configuration.

FIGS. 2*a* and 2*b* illustrate the portion 4*a* of a pallet 4 comprising the housing 18 receiving pallet stone 14. This portion 4*a* is made of a shape memory alloy able to undergo a reversible transformation from an austenitic crystallographic phase to a martensitic crystallographic phase when it passes respectively above or below a determined transformation temperature. Portion 4*a* can be made of a Ni—Ti, Ni—Ti—X or Cu—Al—X alloy, X belonging to the group of metal doping agents. These alloys and the methods of education are well known and are described particularly in an article by NASA, SP 5110 published in 1972 and entitled "22 Nitinol the alloy with a memory: its physical metallurgy properties and applications". For obvious reasons, the shape memory alloy chosen to form portion 4*a* of the pallet will have a martensite/austenite transformation temperature outside the pallet use temperature range which typically ranges from −20° C. to 50° C. For the sake of simplicity, this temperature range will be designated as the "ambient temperature" in the following description.

In the example illustrated, housing 18 is formed in an end part of arm 19 by a notch delimited by jaws 32, 34. Jaws 32 and 34 are configured so as to be able to close in the direction of housing 18 and thus grip pallet stone 14 disposed therein. Jaw 32 is fixed and jaw 34 is mobile between a first position called the loosened position (FIG. 2*a*) in which the pallet stone can be introduced into housing 18 and moved therein, particularly for the purpose of adjusting the penetration P and a second position called the gripping position (FIG. 2*b*) in which the jaws fixedly grip the pallet stone and immobilise it in housing 18. In order for the pallet stone to be gripped efficiently and stably, jaw 32 has two flat, aligned gripping surfaces 32*a*, 32*b* for cooperating with a face 14*a* of the pallet stone and jaw 34 comprises one gripping surface 34*a* for cooperating with one face 14*b* of the pallet stone, opposite face 14*a*. The gripping surfaces 32*a* and 32*b* extend on either side of a recess 33 arranged in fixed jaw 32. In order to balance the gripping forces on the pallet stone, gripping surface 34*a* extends substantially between the two gripping surfaces 32*a* and 32*b*. Jaws 32 and 34 thus grip the pallet stone securely at three points in its housing.

At the ambient temperature, jaw 34 is in a gripping position.

According to a first embodiment, pallet portion 4*a* is made of a shape memory alloy having a martensitic crystallographic phase at the ambient temperature. In such case, a temperature increase beyond the martensite/austenite transformation temperature induces a deformation of jaw 34 bringing the latter into the loosened position. If pallet portion 4*a* is kept above this transformation temperature, the jaw remains in its loosened position so that pallet stone 14 can easily be introduced into housing 18 and its position in the housing can be adjusted in order to obtain the desired penetration P. Once this adjustment has been made, one has only to let pallet portion 4*a* return to the ambient temperature in order to return jaw 34 to the gripping position. In order to readjust penetration P or replace the pallet stone if necessary, one only has to bring pallet portion 4*a* back above the transformation temperature. In order to make a pallet in accordance with this embodiment, one could for example use a Ni—Ti alloy having a martensite/austenite temperature range comprised between 80° C. and 100° C.

Educating the pallet in order to open the clamp by heating the pallet above the martensite/austenite transformation temperature typically occurs as follows. (a) first of all a pallet is made, for example by machining, in which jaw 34 is in the loosened position (FIG. 2*a*) from a shape memory alloy in the martensitic phase at the ambient temperature. (b) The pallet is then heated to above its martensite/austenite transformation temperature to bring the pallet to the austenitic phase. (c) The pallet is then allowed to cool to the ambient temperature which returns the pallet to its martensitic phase. (d) At this temperature, jaw 34 is deformed to bring it into the gripping position (FIG. 2*b*). (e) The pallet is then again heated to above its martensite/austenite transformation temperature and it is then observed that the pallet returns to a shape corresponding to the loosened position of jaw 34. Steps (a) to (e) of the education method can be repeated several times.

In order to adjust the penetration, one could advantageously use a device of the type described in EP Patent No. 0918 264, which comprises means for heating the pallet, adapting it to allow jaw 34 to move between the gripping position and the loosened position.

According to a second embodiment, pallet portion 4*a* is made of a shape memory alloy having an austenitic crystallographic phase at ambient temperature. In this case, a drop in temperature below the martensite/austenite transformation temperature induces a deformation of jaw 34 bringing the latter into the loosened position. If pallet portion 4*a* is kept below this transformation temperature, the jaw remains in its loosened position such that pallet stone 14 can easily be introduced into housing 18 and its position in the housing can be adjusted in order to obtain the desired penetration P. Once this adjustment has been made, one has only to let pallet portion 4*a* return to the ambient temperature to return jaw 34 to its gripping position. In order to readjust penetration P or replace the pallet stone if necessary, one has only to allow pallet portion 4*a* to cool to below the transformation temperature. By way of example, the pallet can be cooled using a conventional cooling gas flux such as a nitrogen flux.

In order to make a pallet in accordance with this embodiment one could for example use a Ni—Ti alloy with a martensite/austenite transformation temperature range comprised between −80° and −50° C.

Educating the pallet in order to open the clamp by cooling the pallet below the martensite/austenite transformation temperature typically occurs in the following manner. (i) first of all a pallet is made, for example by machining, in which jaw 34 is in the gripping position (FIG. 2*b*) from a shape memory alloy in the austenitic phase at the ambient temperature. (ii) The pallet is then cooled to below its martensite/austenite transformation temperature to bring the pallet to the martensitic phase. (iii) At this temperature and in this phase, jaw 34 is deformed to bring it into the loosened position (FIG. 2*a*). (iv) The pallet is then again heated to above its martensite/austenite transformation temperature and it is then observed that the pallet returns to a shape corresponding to the gripping position of jaw 34. Steps (ii) to (iv) of the education method can be repeated several times.

The invention is of course not limited to the embodiments described hereinbefore and it is clear that various alterations and/or improvements evident to those skilled in the art could be made without departing from the scope of the invention defined by the annexed claims. In particular, a construction of portion 4*a* could be envisaged in which the two jaws 32 and 34 are mobile via the effect of heating or cooling. One could also envisage in a variant making jaw 32 with a single gripping surface. According to another variant, one could also add a drop of adhesive extending onto the pallet stone and the pallet in the gripping position in order to stabilise the securing of the pallet stone to the latter once penetration P has been adjusted. In this case, the adhesive used will preferably be an adhesive which is resistant to shocks, to the detergent used for washing the pallets, and to aging, like for example an epoxy adhesive.

The invention claimed is:

1. A device for fixing a pallet-stone on an escapement anchor comprising:

at least one seat provided to receive the pallet-stone, said seat having a longitudinal axis, wherein a portion of the anchor comprising the seat comprises a shape memory alloy adapted to undergo a reversible transformation from an austenitic crystallographic phase into a martensitic crystallographic phase, wherein the seat is bounded by jaws configured to re-close in a direction of the seat, wherein a first jaw is fixed and a second jaw is movable between a first unclamped position in which the pallet-stone may be introduced into the seat and be shifted therein along said longitudinal axis, and a second clamped position in which the jaws clamp the pallet-stone fixedly and immobilize the pallet-stone in the seat and wherein the first jaw has two flat clamping surfaces in alignment and separated by a recess, and wherein the second jaw has a clamping surface disposed essentially parallel to facing the two clamping surfaces of the first jaw in the clamped position.

2. The fixing device according to claim 1, wherein the portion of the anchor comprising said seat does not clamp the pallet-stone substantially when the portion of the anchor is in the martensitic crystallographic phase so that the pallet-stone may be shifted in said seat and wherein the portion of the anchor comprising said seat clamps the pallet-stone fixedly when the portion of the anchor is in the austenitic crystallographic phase while the portion of the anchor is at ambient temperature.

3. The fixing device according to claim 1, wherein the portion of the anchor comprising said seat does not clamp the pallet-stone substantially when the portion of the anchor is in the austenitic crystallographic phase so that the pallet-stone can be shifted in said seat and wherein the portion of the anchor comprising said seat clamps the pallet-stone fixedly when the portion of the anchor is in the martensitic crystallographic phase while the portion of the anchor is at ambient temperature.

4. The fixing device according to claim 1, wherein said shape memory alloy is a nickel and titanium alloy.

5. The fixing device according to claim 1, further comprising a spot of adhesive extending on to the pallet-stone and the anchor in order to stabilize fixation of the pallet-stone on the anchor.

* * * * *